US006012261A

United States Patent [19]

McDonald

[11] Patent Number: 6,012,261

[45] Date of Patent: Jan. 11, 2000

[54] METHOD OF INSTALLING WALL-TO-WALL CARPET

[76] Inventor: William Raiford McDonald, 1300 Tiarco Dr., Dalton, Ga. 30720

[21] Appl. No.: 09/120,207

[22] Filed: Jul. 21, 1998

[51] Int. Cl.[7] ..... E04B 2/00

[52] U.S. Cl. ..... 52/506.01; 52/746.1; 52/177

[58] Field of Search ..... 52/746.1, 741.4, 52/177, 287.1, 288.1, 506.01, 506.05; 156/71

[56] References Cited

U.S. PATENT DOCUMENTS

| | | | |
|---|---|---|---|
| 2,250,669 | 7/1941 | Jamgotchian . | |
| 3,305,428 | 2/1967 | Moore et al. . | |
| 3,496,055 | 2/1970 | Hart, Jr. . | |
| 3,516,894 | 6/1970 | Slosberg . | |
| 3,531,342 | 9/1970 | Dorn . | |
| 3,586,598 | 6/1971 | Beemer . | |
| 3,661,687 | 5/1972 | Spinney, Jr. et al. . | |
| 3,704,197 | 11/1972 | Bahlo . | |
| 3,728,204 | 4/1973 | Cochran, II . | |
| 3,900,656 | 8/1975 | Schmidt . | |
| 3,935,352 | 1/1976 | Toland . | |
| 4,075,377 | 2/1978 | Aitchison et al. . | |
| 4,152,473 | 5/1979 | Layman . | |
| 4,172,917 | 10/1979 | Angelle . | |
| 4,187,337 | 2/1980 | Romageon . | |
| 4,497,853 | 2/1985 | Tomarin . | |
| 4,557,774 | 12/1985 | Hoopengardner . | |
| 4,731,275 | 3/1988 | Andersen . | |
| 4,762,741 | 8/1988 | Hedley . | |
| 4,797,170 | 1/1989 | Hoopengardner | 52/746.1 X |
| 4,849,267 | 7/1989 | Ward et al. | 52/746.1 X |
| 5,040,346 | 8/1991 | White | 52/288.1 |
| 5,116,439 | 5/1992 | Raus | 52/746.1 X |
| 5,401,553 | 3/1995 | Miwa et al. . | |
| 5,470,630 | 11/1995 | Thompson . | |
| 5,501,895 | 3/1996 | Finley . | |
| 5,578,363 | 11/1996 | Finley et al. . | |
| 5,595,041 | 1/1997 | Hoopengardner | 52/746.1 |
| 5,604,009 | 2/1997 | Long . | |

*Primary Examiner*—Beth Aubrey
*Assistant Examiner*—Brian E. Glessner
*Attorney, Agent, or Firm*—Jones & Askew

[57] ABSTRACT

There is disclosed an improved method of installing wall-to-wall carpet. The method comprises installing a wall-to-wall carpet on a substrate bounded at least partially by opposed walls by applying to the substrate an intermediate member having a top surface, applying to the top surface of the intermediate member the bottom surface of the carpet, the top surface of the intermediate member and the bottom surface of the carpet being constructed such that the surfaces resist relative movement between the intermediate member and the carpet; and cutting the carpet to conform to a desired shape at least partially bounded on two sides by the opposed walls.

23 Claims, No Drawings

METHOD OF INSTALLING WALL-TO-WALL CARPET

FIELD OF INVENTION

The present invention relates generally to carpets, and, more specifically, to an improved method of installing wall-to-wall carpet.

BACKGROUND OF THE INVENTION

Wall-to-wall carpet has been a popular floor covering for many years. However, the method of installing wall-to-wall carpet has not changed much over the years. Typically, wall-to-wall carpet is installed by nailing tack strips around the periphery of a room in which the carpet is to be installed. If the carpet does not include an integral cushion or pad, a separate cushioning pad may then be placed on the floor between the tack strips. The carpet is cut to a size slightly larger than the actual size of the room. One edge of the carpet is then secured to the tack strips adjacent that edge and trimmed with a knife to exact size, usually to fit under a baseboard. The carpet is then stretched so that it is under tension and the opposite edge of the carpet is secured to the tack strip adjacent that opposite wall. A similar procedure is followed to secure the lateral edges of the carpet. The carpet is then trimmed to the exact dimensions of the room so that the carpet extends from wall-to-wall.

It is necessary to stretch wall-to-wall carpet when it is installed so that the carpet will not wrinkle, puckering, buckle or otherwise assume a non-planar shape due to dimensional changes of the carpet. Since the carpet is bounded on opposite ends by fixed walls, any significant increase in the length of the carpet due to increases in humidity or moisture conditions will produce wrinkling, puckering or buckling of the carpet. Therefore, carpets are usually stretched or "kicked in" during installation to avoid problems associated with humidity or moisture induced dimensional changes.

Stretching of wall-to-wall carpet does not always solve the problem of wrinkling or buckling of the carpet over a period of time. Frequently, wall-to-wall carpets must be re-stretched due to elongation of the carpet under tension.

Due to the disadvantages of the tack strip method of installing wall-to-wall carpet, alternative methods of installation have been developed. One such alternative method is to glue the carpet to the floor with an adhesive. However, when the carpet is removed, particularly carpet that includes an integral, cushioning pad, a significant residue is left on the floor requiring relatively large amounts of labor to prepare the floor for a subsequent installation of another floor covering. Furthermore, like tack-strip installed carpet, glued-down carpet cannot easily be removed for cleaning.

Another alternative method of installation of wall-to-wall carpet is the hooks and loops, such as Velcro, method of installation. Instead of installing tack strips around the periphery of a room, strips of either hooks or loops are glued to the floor. Corresponding mating strips of hooks or loops are then glued or otherwise attached to the edge of the carpet so that when the strip on the floor is contacted with the strip on the carpet, the hooks and loops will form a temporary mechanical bond.

The traditional methods of installing wall-to-wall carpet described above have several disadvantages. First, they are labor intensive and time consuming processes, and, therefore, are relatively expensive to perform. Second, installation is relatively permanent; therefore, the carpet cannot be easily removed for cleaning. Third, installation requires special tools. Fourth, the installation is not conducive to working with combinations of carpets, colors and the like, for design development and color contrast visual effects. Last, the take-up and removal of traditionally installed carpet is a relatively significant portion of the cost of replacing carpet. Thus, a need exists for an improved method of installing wall-to-wall carpet that overcomes the disadvantages of the prior art.

SUMMARY OF THE INVENTION

The present invention satisfies the above-described needs by providing an improved method of installing wall-to-wall carpet. The method comprises installing a wall-to-wall carpet on a substrate bounded at least partially by opposed walls by securing to the substrate an intermediate member having a top surface, applying to the top surface of the web the bottom surface of the carpet, the top surface of the intermediate member and the bottom surface of the carpet being constructed such that the surfaces resist relative movement between the intermediate member and the carpet; and cutting the carpet to conform to a desired shape at least partially bounded on two sides by the opposed walls.

In another embodiment of the present invention, the method comprises installing a wall-to-wall carpet on a substrate bounded at least partially by opposed walls, the carpet having a bottom surface, by applying to the substrate an intermediate member comprising a layer of polyurethane foam attached to a layer of nonwoven textile material, the foam layer being disposed adjacent the substrate; applying to the nonwoven surface of the intermediate member the bottom surface of the carpet, the bottom surface of the carpet having a secondary backing attached thereto such that relative movement between the substrate and the carpet is resisted; and cutting the carpet to conform to a desired shape at least partially bounded on two sides by the opposed walls.

In still another embodiment of the present invention, the method comprises installing a wall-to-wall carpet on a substrate bounded at least partially by opposed walls, the carpet having a bottom surface, by adhering to the substrate an intermediate member comprising a layer of polyurethane foam attached to a layer of nonwoven textile material, the nonwoven layer being disposed adjacent to and adhered to the substrate; applying to the foam layer of the intermediate member the bottom surface of the carpet, the bottom surface of the carpet having a secondary backing attached thereto such that relative movement between the intermediate member and the carpet is resisted; and cutting the carpet to conform to a desired shape at least partially bounded on two sides by the opposed walls.

In another embodiment of the present invention, the method of installing a wall-to-wall carpet on a substrate bounded at least partially by opposed walls, the carpet having a bottom surface, comprises applying a skid-resistant coating to the substrate, applying to the coated substrate the bottom surface of the carpet that includes a skid resistant coating such that the bottom surface and coated substrate resist relative movement between the substrate and cutting the carpet to conform to a desired shape at least partially bounded on two sides by the opposed walls.

In a further embodiment of the present invention, the method of installing a wall-to-wall carpet on a substrate bounded at least partially by opposed walls, said carpet having a bottom surface, comprises applying a skid-resistant coating to the substrate, applying to the coated substrate the bottom surface of the carpet, the bottom surface having a skid resistant coating applied thereto such that the bottom surface and coated substrate resist relative movement between the substrate and the carpet; and cutting the carpet to conform to a desired shape at least partially bounded on two sides by the opposed walls.

In yet another embodiment of the present invention, the method of installing a wall-to-wall carpet on a substrate bounded at least partially by opposed walls, the carpet having a bottom surface, comprises applying a skid-resistant coating to the substrate, applying to the coated substrate the bottom surface of the carpet, the bottom surface having an integrally attached foam cushion with a skid resistant coating applied thereto such that the bottom surface and coated substrate resist relative movement between the substrate and the carpet; and cutting the carpet to conform to a desired shape at least partially bounded on two sides by the opposed walls.

Accordingly, it is an object of the present invention to provide an improved method of installing wall-to-wall carpet.

Another object of the present invention is to provide a method of installing wall-to-wall carpet wherein the carpet can be relatively easily removed.

A further object of the present invention is to provide a method of installing wall-to-wall carpet such that the carpet has improved dimensional stability.

Still another object of the present invention is to provide a method of installing wall-to-wall carpet such that the carpet resists wrinkling, puckering, buckling, bulging or the like due to changes in moisture and/or humidity.

Yet another object of the present invention is to provide a method of installing wall-to-wall carpet that does not require that the carpet be stretched and/or the use of tack strips.

These and other objects, features and advantages of the present invention will become apparent after a review of the following detailed description of the disclosed embodiments and the appended drawing and claims.

DETAILED DESCRIPTION OF THE DISCLOSED EMBODIMENTS

The present invention comprises a method of installing wall-to-wall carpet. This method is novel because it does not require the use of tack strips or other conventional methods of securing the carpet to the floor, and also does not require that the carpet be stretched.

As used herein the term wall-to-wall carpet is used in its conventional sense to mean a carpet that extends over an entire floor area from one vertical wall to the opposing vertical wall. Thus, wall-to-wall carpet is bounded at least partially by opposed walls so that any substantial increase in the length of the carpet after it is installed will result in buckling, puckering or wrinkling of the carpet The term carpet is also used in its conventional sense to mean a carpet that is either tufted or woven.

Tufted carpet is known by those skilled in the art to comprise a primary backing material, made of natural or synthetic fibers, such as a flat strand woven polypropylene, through which yarn is tufted, thereby forming a face pile on one side of the primary backing and loop backs on the other side. The loop backs are usually secured to the primary backing by a precoat adhesive, such as styrene butadiene synthetic rubber, latex, polyurethane polymers, ethyl vinyl acetate and hot melt adhesives. To provide additional dimensional stability, a secondary backing is commonly used. Secondary backing material, made of natural or synthetic fibers, such as leno weave polypropylene, is usually adhesively attached to the primary backing. Adhesives typically used to attach secondary backing to primary backing include, styrene butadiene synthetic rubber, polyurethanes, ethyl vinyl acetates and hot melt adhesives. A typical secondary backing material that comprises a leno weave polypropylene is known as ActionBak® which is available from Amoco Fabrics and Fibers Co. of Dalton, Ga.

Alternately to the secondary backing, or in addition thereto, an integral foam cushion may be applied to the backing of the carpet. Carpet with an integral foam cushion does not require the use of a conventional carpet pad under the carpet when it is installed. The integral foam cushion can be made of natural materials or synthetic materials, such as styrene butadiene rubber and polyurethane. The foam can be cast separately and adhesively applied to the carpet back. Or, the foam cushion can be formed in situ on the carpet back. If the carpet includes an integral foam cushion, it is preferred that the foam be formed in situ on the carpet back and be of polyurethane between approximately 1 mm and 12 mm inches thick and have a density of between approximately 1.5 and 40 pounds per cubic foot. It is well known in the art how to form in situ polyurethane foam on a carpet back, and, therefore, further description will not be provided here.

If the carpet does not have an integral cushion attached thereto, it is typical to install a conventional cushioning pad under the carpet. Cushioning carpet pads are made from a cushioning material, such as foams. But, recently, carpet pads have been made from recycled foam that is cut into relatively small pieces and laminated together into a sheet. Carpet pad is also used herein in its common sense as known by those skilled in the art.

The present invention can be used with all types of carpet, with or without an integral cushion, and on all types of floors. The present invention can be used to apply carpet to floors made of wood, such as plywood or hardwood, concrete, masonry, and the like.

The method of the present invention is practiced as follows. An intermediate member is applied to the floor and extends from wall-to-wall and may be either mechanically or adhesively secured thereto when required as explained further below. The intermediate member has an upper surface that will adjoin the back of the carpet when it is applied that provides either a physical, mechanical or a chemical skid resistance with respect to the carpet back, thereby inhibiting relative movement between the carpet and the intermediate member. The carpet is then disposed on the upper surface of the intermediate member such that the carpet back adjoins the upper surface of the intermediate member. The carpet is then trimmed to fit the dimensions of the floor that it is covering. No tack strips are used to secure the carpet, and no stretching or "kicking in" of the carpet is required. The carpet merely lays on top of the intermediate member. The skid resistant properties between the carpet back and the intermediate member serve to hold the carpet in place. Furthermore, it is believed that the skid resistant properties also function to provide dimensional stability to the carpet such that changes in carpet dimensions due to changes in humidity or moisture levels that would otherwise result in wrinkling, puckering or buckling of the carpet are prevented. It is believed that the relatively small forces of the skid resistant properties when added over the entire area of the carpet result in a relatively substantial force that prevents the carpet from moving significantly due to humidity induced changes in size. Thus, wrinkling, puckering and buckling are prevented even though the carpet is not attached at its edges with tack strips, hooks and loops or adhesives and is not under tension.

As stated above the skid resistant property is an essential element of the present invention. The skid resistant property can be produced in a number of different ways. The skid resistant property can be produced by physical, mechanical or chemical means. Embodiments of several different ways of achieving the desired skid resistant property are disclosed below.

One way to achieve the desired skid resistant property of the present invention is to apply a skid resistant coating to a floor over the entire area that will be covered by the wall-to-wall carpet. Therefore, in this case the coating would be the intermediate member. Coatings that are useful in the present invention are natural and synthetic non-skid polymers that have a high coefficient of slip resistance. Polymers that are useful in the present invention include acrylic polymers, natural latex, soft styrene butadiene rubber, and vinyls. The particular chemistry of the coating is not critical, and, therefore, any other polymer that exhibits slip resistant properties can be used in the present invention. Coefficients of slip resistances for the polymers that are useful in the present invention generally are between approximately 0.25 and 2.00 as measured in accordance with ASTM D2047-93. A particularly useful polymer is an acrylic polymer sold under the trademark Hystretch V-43 by B. F. Goodrich, Gastonia, N.C. Depending on the type of floor that is involved, the polymer coating should be between approximately 0.025 mm and 0.5 mm thick and have a coverage rate of between approximately 0.5 oz and 5 oz per square yard.

When a skid resistant coating is applied to the floor, a compatible skid resistant coating must also be applied to the carpet if the carpet does not already have an affinity for the coating on the floor. By a compatible skid resistant coating is meant one that has a physical attraction to the floor coating, such that the skid resistant properties of the present invention are provided. Preferably, the coating that is applied to the carpet is the same coating that is applied to the floor. Therefore, the polymers that are described above for coating the floor can also be used for coating the carpet back. Depending on the construction of the carpet, the skid resistant polymer coating is applied to the carpet surface that will be adjacent the floor, such as the primary backing, the secondary backing, the integral cushion and the like. The temporary bond between the floor coating and the carpet coating must not be so strong that it makes removal of the carpet difficult or causes delamination of the integral cushion, secondary backing or pulls pile loop backs out of the primary backing.

Another way to achieve the desired skid resistant property of the present invention is to provide a physical or mechanical skid resistance between the intermediate member and the carpet. By mechanical skid resistance is meant that there is provided a physical obstacle that resists movement between the two opposed surfaces. Mechanical skid resistance can be provided by applying to the floor an intermediate member that has a top surface that will physically interfere with movement of the back surface of the carpet. For example, an intermediate member, such as a carpet, having a top surface of a secondary backing, such as ActionBak, will provide the necessary physical interference with a carpet that has a back surface of a secondary backing, such as ActionBak®. It is believed that the uneven surface of the ActionBak® on the carpet interferes with or catches on the uneven surface of the ActionBak® of the intermediate layer and thereby resists the two surfaces slipping or moving relative to each other. Attachment of the intermediate member to the substrate or floor is necessary when there is no affinity between the flooring surface and the surface of the intermediate member adjacent the floor. For example, when the surface of the floor is relatively smooth, such as a smooth tile, such that the intermediate member slides easily on the surface, it is necessary to attach the intermediate member to the floor. Depending on the flooring to which the intermediate layer is applied, it may be desirable to attach the intermediate member to the floor, such as with an adhesive or by stapling or nailing. Any suitable adhesive can be used, such as multipurpose adhesive or pressure sensitive adhesive. Suitable multipurpose adhesives include ATT #677 available from Advanced Adhesives Technology, Dalton, Ga., and #2055 available from W. F. Taylor & Co., Dalton, Ga. Suitable pressure sensitive adhesives include ATT # 320 available from Advanced Adhesives Technology, and # 2027 available from W. F. Taylor & Co. On the other hand, if the surface of the floor is relatively rough, such as rough surfaced fiberboard or concrete, such that the intermediate layer does not easily slide on the floor, the intermediate layer does not have to be attached to the floor and can merely be applied to the floor.

A layer of foam will provide the necessary physical interference with a carpet that has a back surface of a secondary backing, such as ActionBak®. The foam can be made from natural or synthetic polymers, such as polyurethane, styrene butadiene latex and vinyl. The foam should have a thickness of between approximately 1 mm and 12 mm; and a density of between approximately 1.5 pounds per cubic foot and 40 pounds per cubic foot. Conversely, when the intermediate layer has an upper surface of a secondary backing, such as ActionBak®, the back surface of the carpet can be a layer of integral foam cushion. These integral cushions are well known in the art and have been described above. It is believed that the uneven surface of the secondary backing sinks into and forms depression in the adjacent foam surface that thereby resists the two surfaces slipping relative to each other. Therefore, although the present invention has been described as using a secondary backing, such as ActionBak®, any layer that is sufficiently rough or has a sufficiently uneven surface will provide the necessary skid resistance with a corresponding foam surface.

A nonwoven layer of textile material will also provide the necessary physical interference with a carpet that has a back surface of a secondary backing, such as ActionBak®. The nonwoven layer can be made from any textile material, such as polyester, polypropylene and nylon. The nonwoven layer should have a thickness of between approximately 0.25 mm and 4 mm. The nonwoven layer should also have a weight of between approximately 1 and 6 ounces per square yard. It is believed that the uneven surface of the secondary backing sinks into and forms depression in the nonwoven surface that thereby resists the two surfaces slipping relative to each other.

Preferably, the intermediate member is a laminated structure that comprises one layer of a nonwoven textile material adhered to a second layer of a foam material. The nonwoven material and foam material for forming the laminated intermediate member can be chosen from the materials described above. The nonwoven layer should have a thickness of between approximately 0.25 mm and 4 mm. The nonwoven layer should also have a weight of between approximately 1 and 6 ounces per square yard. It is especially preferred that the laminated layer comprises a nonwoven layer of spun laced polyester having a thickness of approximately 0.5 mm and a weight of approximately 2 ounces per square yard. A suitable polyester material is available under the trademark Sontara™ from E. I. Du Pont de Nemours & Co. of Old Hickory, N.C. It is especially preferred that the laminated foam layer comprise a polyurethane foam having a thickness of approximately 1 mm and 12 mm and a density of between approximately 1.5 and 40 pounds per cubic foot; preferably, approximately 20 pounds per cubic foot. A suitable polyurethane foam is available under the trademark Kangacushion™ from Textile Rubber & Chemical Co. Inc. of Dalton, Ga. Furthermore, the nonwoven layer can be adhesively attached to the foam layer, the foam layer can be formed in situ on the nonwoven layer, or the foam layer can be thermally bonded to the nonwoven layer. Methods of bonding nonwoven materials to foam materials are well known in the art, and, therefore, further description is not necessary herein. A suitable laminated intermediate member is available under the trademark KangaCushion™ from Textile Rubber & Chemical Company, Inc. of Dalton, Ga.

When the laminated layer described above is used for the intermediate layer, the laminated layer can be oriented with either the nonwoven layer or the foam layer adjacent the floor. When the laminated layer described above is used for the intermediate layer, it is also desirable for the back surface of the carpet to be a secondary backing, such as ActionBak®. When the nonwoven surface of the laminated layer is adjacent the floor and depending on the type of floor to which it is applied, it may also be desirable to attach the nonwoven layer to the floor, such as by adhesion. Any suitable adhesive can be used, such as multi-purpose adhesives including ATT #677 available from Advanced Adhesives Technology and #2055 available from W. F. Taylor & Co., and pressure sensitive adhesives including ATT # 320 available from Advanced Adhesives Technology, and # 2027 available from W. F. Taylor & Co. The laminated layer can also be attached to the floor by nailing, stapling and the like. Alternately, a coating of a slip resistant polymer as described above, such as Hystretch V-43 by B. F. Goodrich, Gastonia, N.C., can be applied to the floor before the nonwoven layer is applied thereto. The slip resistant polymer provides sufficient affinity between the nonwoven layer and the coated floor such that the advantages of the present invention are realized.

The fact that the carpet is not attached at its edges provides unexpected advantages over conventionally installed carpet. Since the carpet is not attached in a conventional manner, it can be lifted off the intermediate member at any time and without special tools. The carpet can be removed by merely grasping the edge of the carpet, lifting the edge of the carpet off the intermediate member and rolling the carpet into a roll. The carpet can then be taken to a remote location for cleaning. After the carpet is cleaned, it can be reinstalled by merely unrolling the carpet on the intermediate member in the same orientation as originally installed so that the edges of the carpet match the walls of the room in which the carpet is installed. No special tools or materials are required to reinstall the carpet.

The same procedure can be followed when it is desired to replace an old carpet with a new carpet. The old carpet can be removed as described above, and the new carpet can be installed as described above. Thus, it should be appreciated that the present invention requires significantly less labor to initially install a carpet, to remove the old carpet and to replace an old carpet with a new carpet.

The following examples are illustrative of the present invention and are not intended to limit the scope of the invention as set forth in the appended claims.

EXAMPLE 1

A basement room approximately 20 feet by 20 feet is to be carpeted using the present invention. The basement floor is concrete and is located below grade. In summer, the basement is subjected to considerable amounts of humidity; whereas, in winter the humidity is quite low. Therefore, the basement environment is subjected to relatively large seasonal humidity variations.

The old carpet is removed and the floor is cleaned of any remaining debris so that the concrete floor presents a clean smooth surface. The tack strips from the old carpet are removed and discarded.

A tufted carpet having a nylon face pile and a secondary backing of ActionBak® is placed on the concrete floor with the face pile down or adjacent the floor. The carpet is trimmed with a conventional carpet knife to conform to the size and shape of the room so that the edges of the intermediate carpet meet the baseboard of the vertical walls bordering the room.

A similar piece of carpet with a nylon face pile and a secondary backing of ActionBak® is placed on the intermediate carpet such that the ActionBak® of the carpet contacts the ActionBak® of the intermediate carpet. The top carpet is the trimmed with a conventional carpet knife to conform to the size and shape of the room so that the edges of the carpet meet the baseboard of the vertical walls bordering the room. No other means of securing the carpet to the floor are used.

Over a period of one year, the carpet is observed. During that time period no wrinkling, puckering or buckling of the carpet is observed.

EXAMPLE 2

An office hallway approximately 5 feet by 40 feet is to be carpeted using the present invention. The hallway is concrete and heavily trafficked.

The old carpet is removed and the floor is cleaned of any remaining residue or debris so that the concrete floor presents a clean smooth surface. The tack strips from the old carpet are removed and discarded.

A coating of an acrylic polymer obtained from B. F. Goodrich under the trademark Hystretch V-43 is applied to the concrete floor. The coating is applied at the rate of 2 oz per square yard of floor. It is estimated that the coating has a thickness of approximately 0.10 mm. When the coating is dry, it has a slight tack to the touch.

A piece of tufted carpet with a nylon face pile and an integrally attached polyurethane foam cushion is obtained. The foam cushion is approximately 0.25 inches thick and has a density of approximately 7 pounds per cubic foot. The surface of the foam cushion has a skin coating of the same acrylic polymer that is applied to the floor. The carpet is rough cut to a size slightly larger than the size of the hallway. The carpet is then placed on the floor so that the foam cushion is adjacent the floor; i.e., so the coated polyurethane foam surface contacts the intermediate coating on the floor. The carpet is then trimmed with a conventional carpet knife to conform to the size and shape of the hallway so that the edges of the carpet meet the baseboard of the vertical walls bordering the hallway.

Over a period of one year, the carpet is observed. During that time period no wrinkling, puckering or buckling of the carpet is observed. After the one year period, the carpet is removed by grasping the edge of the carpet and pulling up the edge. The carpet is then gradually rolled into a roll. The roll of carpet is taken to a commercial carpet cleaner and cleaned using conventional rug cleaning apparatus.

The cleaned carpet is then placed back down on the hallway floor so that the foam cushion is adjacent the floor and so that the edges of the carpet meet the walls. Over an additional period of one year, the carpet is observed. During the second time period, no wrinkling, puckering or buckling of the carpet is observed.

EXAMPLE 3

A living room of a new house approximately 20 feet by 40 feet is to be carpeted using the present invention. The room has a plywood subfloor. The plywood floor is cleaned of any construction debris so that the wooden floor presents a clean smooth surface. No tack strips are installed.

A piece of KangaCushion™ obtained from Textile Rubber & Chemical Company, Inc. is rough cut to a size slightly larger than the living room. The KangaCushion™ is a 2 mm shoe foam having a laminated structure of a nonwoven spun polyester layer and a polyurethane foam layer. The KangaCushion™ is laid on the plywood floor so that the nonwoven layer is adjacent the floor. The KangaCushion™ is then trimmed with a conventional carpet knife to conform to the size and shape of the living room so that the edges of the KangaCushion™ meet the baseboard of the vertical walls bordering the living room.

The KangaCushion™ is then rolled up half way from one of its edged. A coating of an acrylic polymer obtained from B. F. Goodrich under the trademark Hystretch V-43 is applied to the exposed portion of the plywood floor. The polymer is applied at the rate of 2 oz per square yard of floor. It is estimated that the coating has a thickness of approximately 0.10 mm. The KangaCushion™ is then rolled back down onto the dried skid resistant polymer. The other half of the KangaCushion™ is then rolled up from the opposite edge. The polymer is then applied to the other portion of the plywood floor in the same manner described above. The KangaCushion™ is then rolled back down onto the polymer.

A piece of tufted carpet with a polyester face pile and an secondary backing of ActionBak® is obtained. The carpet is rough cut to a size slightly larger than the size of the living room. The carpet is then placed on the floor so that the ActionBak® is adjacent the foam layer of the KangaCushion™. The carpet is then trimmed with a conventional carpet knife to conform to the size and shape of the living room so that the edges of the carpet meet the baseboard of the vertical walls bordering the hallway.

Over a period of one year, the carpet is observed. During that time period no wrinkling, puckering or buckling of the carpet is observed.

EXAMPLE 4

A living room of a new house approximately 20 feet by 40 feet is to be carpeted using the present invention. The room has a plywood subfloor. The plywood floor is cleaned of any construction debris so that the wooden floor presents a clean smooth surface. No tack strips are installed.

A piece of KangaCushion™ obtained from Textile Rubber & Chemical Company, Inc. is rough cut to a size slightly larger that the living room. The Kangacushion™ is a 2 mm shoe foam having a laminated structure of a nonwoven spun polyester layer and a polyurethane foam layer. The Kangacushion™ is laid on the plywood floor so that the foam layer is adjacent the floor. The KangaCushion™ is then trimmed with a conventional carpet knife to conform to the size and shape of the living room so that the edges of the Kangacushion™ meet the baseboard of the vertical walls bordering the living room.

A piece of tufted carpet with a polyester face pile and a secondary backing of ActionBak® is obtained. The carpet is rough cut to a size slightly larger than the size of the living room. The carpet is then placed on the floor so that the ActionBak® is adjacent the nonwoven layer of the KangaCushion™. The carpet is then trimmed with a conventional carpet knife to conform to the size and shape of the living room so that the edges of the carpet meet the baseboard of the vertical walls bordering the hallway.

Over a period of one year, the carpet is observed. During that time period no wrinkling, puckering or buckling of the carpet is observed.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A method of installing a wall-to-wall carpet on a substrate bounded at least partially by opposed walls, said carpet having a bottom surface, said method comprising the steps of:

applying to said substrate an intermediate member having a top surface, said intermediate member extending from wall-to-wall;

applying to said top surface of said intermediate member said bottom surface of said carpet which extends from wall-to-wall, said bottom surface of said carpet comprising a woven secondary backing and said top surface of said intermediate member being constructed such that said surfaces provide sufficient mechanical skid resistance to resist relative lateral movement between said intermediate member and said carpet such that said carpet resists dimensional changes due to changes in moisture or humidity without the use of tack strips securing the periphery of said carpet to said substrate, said top surface of said intermediate member and said bottom surface of said carpet being substantially free of adhesive for retaining said carpet and said intermediate member together; and cutting said carpet to conform to a desired shape at least partially bounded on two sides by said opposed walls.

2. The method of claim 1, wherein said intermediate member has a skid resistant coating on the surface adjacent the bottom surface of the carpet.

3. The method of claim 1, wherein said intermediate member is adhesively attached to said substrate.

4. The method of claim 1, wherein said carpet has an integral foam cushion attached to said bottom surface.

5. The method of claim 1, wherein said intermediate member has an integral foam cushion attached to said top surface.

6. The method of claim 1, wherein said intermediate member has secondary backing attached to said top surface.

7. The method of claim 1, wherein said intermediate member is a nonwoven textile material.

8. The method of claim 1, wherein said intermediate member is a nonwoven textile material having a layer of foam on the surface adjacent the bottom surface of the carpet.

9. The method of claim 1, wherein said intermediate member is a nonwoven textile material having a layer of foam on the surface adjacent the bottom surface of the carpet and wherein said secondary backing is leno weave polypropylene.

10. The method of claim 1, wherein said intermediate member is a tufted carpet.

11. The method of claim 1, wherein said carpet is a tufted carpet.

12. The method of claim 1, wherein said carpet is a woven carpet.

13. The method of claim 1, wherein said intermediate member is a tufted carpet having a woven polypropylene secondary backing adhered to the surface adjacent the bottom surface of the carpet and said carpet has a woven polypropylene secondary backing attached to said bottom surface of said carpet.

14. A method of installing a wall-to-wall carpet on a substrate bounded at least partially by opposed walls, said carpet having a bottom surface, said method comprising the steps of:

applying to said substrate an intermediate member comprising a layer of polyurethane foam attached to a layer of nonwoven textile material, said foam layer being disposed adjacent said substrate;

applying to said nonwoven surface of said intermediate member said bottom surface of said carpet, said bottom surface of said carpet having a woven polypropylene secondary backing attached thereto such that relative lateral movement between said substrate and said carpet is resisted without the use of tack strips securing the periphery of said carpet to said substrate, said nonwoven surface of said intermediate member and said bottom surface of said carpet being substantially free of adhesive for retaining said carpet and said intermediate member together; and cutting said carpet to conform to a desired shape at least partially bounded on two sides by said opposed walls.

15. A method of installing a wall-to-wall carpet on a substrate bounded at least partially by opposed walls, said carpet having a bottom surface, said method comprising the steps of:

applying to said substrate an intermediate member comprising a layer of polyurethane foam attached to a layer of nonwoven textile material, said nonwoven layer being adjacent said substrate;

applying to said foam layer surface of said intermediate member said bottom surface of said carpet, said bottom surface of said carpet having a woven polypropylene secondary backing attached thereto such that relative lateral movement between said intermediate member and said carpet is resisted without the use of tack strips securing the periphery of said carpet to said substrate, said foam layer surface of said intermediate member and said bottom surface of said carpet being substantially free of adhesive for retaining said carpet and said intermediate member together; and cutting said carpet to conform to a desired shape at least partially bounded on two sides by said opposed walls.

16. The method of claim 15 further comprising the step of applying a coating of a nonskid material to said substrate before said intermediate layer is applied thereto.

17. The method of claim 15 further comprising the step of securing the intermediate layer to the substrate before applying the carpet thereto.

18. The method of claim 15 further comprising the step of adhering the intermediate layer to the substrate before applying the carpet thereto.

19. A method of installing a wall-to-wall carpet on a substrate bounded at least partially by opposed walls, said carpet having a bottom surface, said method comprising the steps of:

applying a skid resistant coating to said substrate, applying to said coated substrate said bottom surface of said carpet such that said bottom surface and coated substrate resist relative lateral movement between said substrate and said carpet without the use of tack strips securing the periphery of said carpet to said substrate, said coated substrate and said bottom surface of said carpet being substantially free of adhesive for retaining said carpet and said substrate together; and cutting said carpet to conform to a desired shape at least partially bounded on two sides by said opposed walls.

20. A method of installing a wall-to-wall carpet on a substrate bounded at least partially by opposed walls, said carpet having a bottom surface, said method comprising the steps of:

applying a skid resistant coating to said substrate, applying to said coated substrate said bottom surface of said carpet, said bottom surface having a skid resistant coating applied thereto such that said bottom surface and coated substrate resist relative lateral movement between said substrate and said carpet, said substrate and said bottom surface of said carpet being substantially free of adhesive for retaining said carpet and said substrate together; and cutting said carpet to conform to a desired shape at least partially bounded on two sides by said opposed walls.

21. A method of installing a wall-to-wall carpet on a substrate bounded at least partially by opposed walls, said carpet having a bottom surface, said method comprising the steps of:

applying a skid resistant coating to said substrate, applying to said coated substrate said bottom surface of said carpet, said bottom surface having an integrally attached foam cushion with a skid resistant coating applied thereto such that said bottom surface and coated substrate resist relative lateral movement between said substrate and said carpet, said substrate and said bottom surface of said carpet being substantially free of adhesive for retaining said carpet and said substrate together; and cutting said carpet to conform to a desired shape at least partially bounded on two sides by said opposed walls.

22. A method of installing a wall-to-wall carpet on a substrate bounded at least partially by opposed walls, said carpet having a bottom surface, said method comprising the steps of:

applying an intermediate member to said substrate, said intermediate member having an upper surface opposite said substrate;

applying to said upper surface of said intermediate member said bottom surface of said carpet, said bottom surface of said carpet comprising a leno weave secondary backing and said top surface of said intermediate member being constructed such that said bottom surface and top surface provide sufficient mechanical skid resistance to resist relative lateral movement between said intermediate member and said carpet such that said carpet resists dimensional changes due to changes in moisture or humidity without the use of tack strips securing the periphery of said carpet to said substrate, said upper surface of said intermediate member and said bottom surface of said carpet being substantially free of adhesive for retaining said carpet and said intermediate member together; and cutting said carpet to conform to a desired shape at least partially bounded on two sides by said opposed walls.

23. The method of claim 22 further comprising the step of adhering said intermediate member to said substrate before applying said carpet.

* * * * *